US009953796B2

(12) United States Patent
Huang et al.

(10) Patent No.: US 9,953,796 B2
(45) Date of Patent: Apr. 24, 2018

(54) NANO VACUUM GAP DEVICE WITH A GATE-ALL-AROUND CATHODE

(71) Applicant: HRL Laboratories, LLC, Malibu, CA (US)

(72) Inventors: Biqin Huang, Torrance, CA (US); Christopher S. Roper, Santa Monica, CA (US); Tahir Hussain, Calabasas, CA (US)

(73) Assignee: HRL Laboratories, LLC, Malibu, CA (US)

( * ) Notice: Subject to any disclaimer, the term of this patent is extended or adjusted under 35 U.S.C. 154(b) by 5 days.

(21) Appl. No.: 15/098,108

(22) Filed: Apr. 13, 2016

(65) Prior Publication Data

US 2016/0307722 A1 Oct. 20, 2016

Related U.S. Application Data

(60) Provisional application No. 62/147,284, filed on Apr. 14, 2015.

(51) Int. Cl.

| | |
|---|---|
| ***H01J 1/62*** | (2006.01) |
| ***H01J 1/308*** | (2006.01) |
| ***H01J 1/304*** | (2006.01) |
| ***H01J 9/02*** | (2006.01) |
| ***H01J 21/10*** | (2006.01) |

(52) U.S. Cl.

CPC ..... *H01J 1/308* (2013.01); *H01J 1/304* (2013.01); *H01J 9/025* (2013.01); *H01J 21/10* (2013.01)

(58) Field of Classification Search

USPC ..... 313/310, 311, 336, 351, 495

See application file for complete search history.

(56) References Cited

U.S. PATENT DOCUMENTS

| | | | |
|---|---|---|---|
| 6,057,636 | A | 5/2000 | Sakai et al. |
| 6,297,586 | B1 | 10/2001 | Nakayama et al. |
| 8,699,206 | B1 | 4/2014 | Hubler et al. |
| 2002/0140356 | A1 | 10/2002 | Small |
| 2008/0164802 | A1 | 7/2008 | Nishibayashi et al. |
| 2010/0270584 | A1 | 10/2010 | Cottet et al. |

FOREIGN PATENT DOCUMENTS

| | | |
|---|---|---|
| EP | 1251543 | 10/2002 |
| EP | 2161746 | 3/2010 |

OTHER PUBLICATIONS

International Search Report and Written Opinion of the International Searching Authority from PCT/US/2016/027384 dated Jul. 18, 2016.

International Preliminary Report on Patentability (IPRP) Chapter I from PCT/US2016/027384 dated Oct. 26, 2017.

*Primary Examiner* — Vip Patel

(74) *Attorney, Agent, or Firm* — Ladas & Parry

(57) ABSTRACT

A semiconductor power handling device, includes a cathode pillar, a gate surrounding the cathode pillar, and an anode spaced from the cathode by a nano-vacuum gap. An array of semiconductor power handling devices, each comprising a cathode pillar, a gate surrounding the cathode pillar, and an anode spaced from the cathode pillar by a nano-vacuum gap. The semiconductor power handling devices can be arranged as rows and columns and can be interconnected to meet the requirements of various applications. The array of power handling devices can be fabricated on a single substrate.

31 Claims, 7 Drawing Sheets

NANO VACUUM GAP DEVICE WITH A GATE-ALL-AROUND CATHODE

CROSS-REFERENCE TO RELATED APPLICATIONS

This application claims the benefit of U.S. Provisional Patent Application No. 62/147,284, filed Apr. 14, 2015, which is incorporated herein by reference in its entirety.

BACKGROUND OF THE INVENTION

Field of the Invention

The present invention relates to a nano vacuum gap power switching semiconductor device, and in particular to a device which has improved frequency range, reduced noise and increased power handling capability facilitated by the gate all-around cathode design and a nano scale vacuum gap design.

Discussion of the Prior Art

Vacuum gap power handling devices are known. Such devices consist of a cathode, an anode spaced apart from the cathode, and a control electrode (often called Gate) adjacent the cathode and the anode. In general, the cathode is a pointed structure from which electrons are emitted when subjected to an electric field of sufficient strength. The anode provides the necessary electric field, and the control electrode controls the flow of electrons from the cathode to the anode.

One skilled in the art understands that some vacuum gap devices may operate at room temperature, and that cathodes in such devices are termed 'cold-cathodes'. The operating temperature of vacuum gap devices in the present invention is not germane to the present invention. In the present application, the term 'cathode' is intended to include devices operating at both room temperature and other operating temperatures. The terms 'cold-cathode' and 'cathode' are used interchangeably in the present application.

One example is a vacuum power switch using carbon nanotubes as the electron cathode. Such a vacuum power switch comprises a cathode, an anode and a current switching grid between the cathode and the anode, in which the cathode comprises an array of aligned carbon nanotubes extending toward the anode. The anode is a plate fabricated opposed to the carbon nanotube cold-cathode. The control electrode is fabricated as a grid located between the cold-cathode and the anode. In this example, the grid or gate to cathode separation is relatively large requiring a large gate bias to effectuate the necessary electric fields.

Another example of a power switching device of field-emission type is one using a tip array. Such a device comprises an emitter electrode, an anode electrode, a cone-shaped emitter, and a gate [control] electrode. When a high voltage is applied between the emitter electrode and the anode electrode, the emitter emits electrons, whereby main current flows. The main current is controlled by supplying a control signal to the gate. This example requires a large bias due to relatively large grid and cathode separation.

A third example is a micro power switch that uses a cathode with a tip structure, and a driving method to control the flow of electrons. A micro power switch according to this third example comprises: a cold cathode for emitting electrons; an anode for capturing the electrons emitted from the cold cathode; and a control electrode for controlling an amount of the electrons emitted from the cold cathode. The cold cathode is made of material having a smaller electron emission barrier as that of the control electrode. The anode is applied with a positive potential in relation to the cold cathode, and the control electrode is applied with a potential equal to or lower than a potential of the cold cathode. In this condition, the electron emission from the cold cathode is stopped. This example also requires relatively large bias voltage due to the relatively large cold-cathode to control electrode distance.

There is a compelling need in this industry for a semiconductor based vacuum gap power switch that provides for a highly efficient electron emission without a need for a large gate bias that allows for high frequency, high power and low noise operation. This invention fills this critical need.

BRIEF SUMMARY OF THE INVENTION

In contrast with the prior art, a vacuum gap device according to principles of the present invention utilizes a gate-all-around cathode enabling relatively low voltage operation and utilizes a nano-scale vacuum gap channel enabling low noise, and high frequency operation. If the gap is less than the electron mean free path in the surrounded environment, the device doesn't require low pressure or vacuum conditions for successful device operation.

In accordance with principles of the present invention, a power handling device includes a cathode pillar, a gate surrounding the cathode pillar, and an anode spaced from the cathode by a nano-vacuum gap. The cathode is a gate-all-around structure with a metal/dielectric/semiconductor, a metal/dielectric/metal, or similar nano-pillar feature.

Putting the gate closer to the cathode using this gate-all-around structure provides a large local electric field without requiring a relatively large gate bias voltage. The use of a nano vacuum gap structure inside of silicon increases the local electric field, leading to high efficiency electron emission.

A nano scale vacuum gap device design according to principles of the present invention enables high speed operation, due to a shorter vacuum channel, and wafer level processing instead of traditional vacuum electronic device fabrication techniques relying on individual device processing and packaging. Such a vacuum power switch also has the higher frequency range and larger power handling capabilities associated with vacuum power handling devices, as opposed to conventional semiconductor devices. The use of a gated two-dimensional-electron-gas (2 DEG) field emission structure further enables highly efficient electron emission at low bias. The nano-scale vacuum gap channel allows low noise operation due to the ballistic electron transport mechanism in a vacuum which does not exhibit the scattering which occurs in traditional semiconductor power handling devices. The potential applications for such power handling devices include RF switches and high power RF and microwave applications.

DETAILED DESCRIPTION OF THE INVENTION

It should be understood at the outset that, although example embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

Figure 1A:
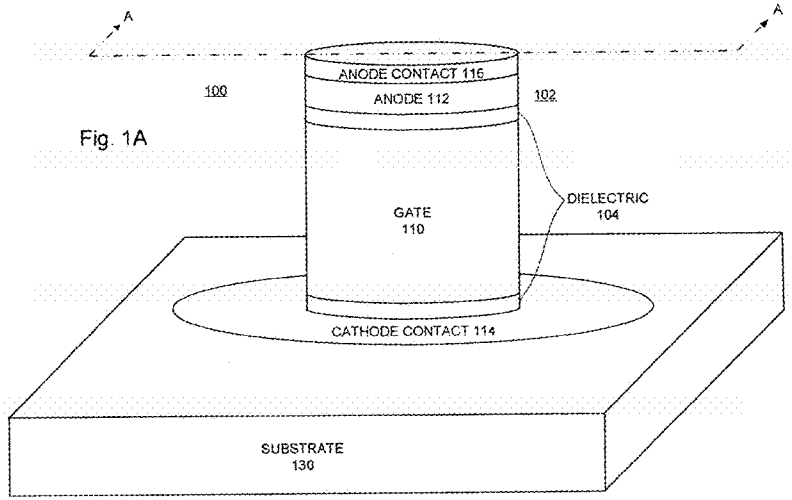
FIG. 1A is an oblique view illustration of a vacuum gap power handing device.
Figure 1B:
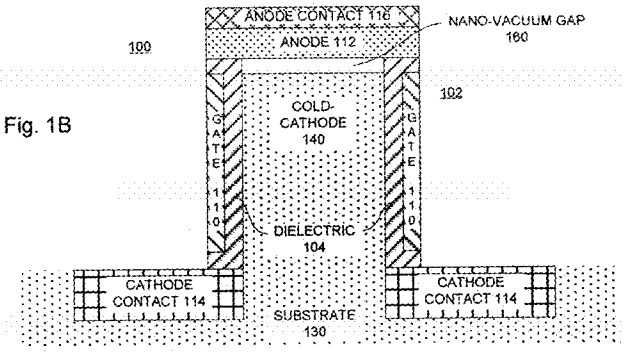
FIG. 1B is a cross-sectional illustration of the vacuum gap power handling device of FIG. 1A, in accordance with principles of the present invention.

FIG. 1A is an oblique view illustration of a vacuum gap power handing device 100 in accordance with principles of the present invention, and FIG. 1B is a cross-sectional view of the vacuum gap power handling device 100 of FIG. 1A along section A-A. In FIG. 1A, a cathode pillar 140 is fabricated from a substrate 130 which may be Si, GaN, diamond, SiC or other similar materials. Other examples include taking a silicon substrate and depositing other suitable materials such as nano-crystalline diamond to form a cathode out of diamond layer. In FIG. 1A, the cathode pillar 140 is cylindrical with a circular cross-section. One skilled in the art understands that the pillar 140 is not necessarily a round cross-section cylinder and may have any cross-sectional shape and that shape may vary from the top of the pillar to the bottom. For example, the cathode pillar 140 can be any prism or a pyramid with any cross section. Another example is a pointed cone. Typically, the cross-sectional size of the pillar is less than one micron. However, the cross-sectional size may be between 100 nm and 1 μm. A gate-all-around cathode structure 102 comprises a cathode 140, a gate 110 and a dielectric 104 between the gate and the cathode. The gate-all-around structure 102 is first formed by having a dielectric layer 104 formed on the side of the cathode cylindrical pillar 140, and then forming a metal gate layer 110 on the side of the dielectric layer 104 (see FIG. 1B). A cathode contact 114 is formed at the top of the substrate 130, adjacent to the cathode pillar 140. The dielectric layer 104 insulates the gate 110 from the cathode contact 114. The dielectric layer 104 also forms a spacer above the top of the cathode pillar 140. An anode 112 is formed above the top of the cathode pillar 140 and spaced from it by the dielectric layer 104 to form a nano-vacuum gap 160 (FIG. 1B). Typically, the cathode 140 and the anode 112 are the same material, e.g. Si, GaN, diamond, SiC or other similar material. However, one skilled in the art understands that the anode may be other materials. The dielectric layer 104 such as high k dielectric $Al_2O_3$, the metal gate layer 110 such as Aluminum, the cathode contact 114 such as Titanium and the anode contact 116 such as Titanium can be of any suitable material As used in this application, the term "nano-vacuum gap" means a gap having a width which is typically less than 100 nm and within which the vacuum pressure is typically less than 1 Torr. However, one skilled in the art understands that the gap may have a width between 1 nm and 1 μm, although a gap of from 10 nm to 1 μm is preferred. One skilled in the art further understands that the vacuum pressure in the gap may have a pressure between 1 microtorr and atmosphere pressure, although a pressure from 1 millitorr to 10 Torr is preferred. The dielectric layer 104 also insulates the cathode pillar 140 and the gate layer 110 from the anode 112. An anode contact 116 is formed atop the anode 112. One skilled in the art recognizes that FIGS. 1A and 1B illustrate one arrangement of a power handling device 100, and that other arrangements of layers and different embodiments may be formed which remain in accordance with principles of the present invention.

In operation, the cathode contact 114 is maintained at a first potential, and the anode contact 116 is maintained at a second potential higher than the first potential. An electric field is formed between the surface of the cathode pillar 140 and the anode 112. If the electric field is large enough, electrons are emitted from the top of the cathode 140 into the nano-vacuum gap 160 and to the anode 112, and current flows from the cathode 140 to the anode 112. (The dielectric 104, having no free electrons, does not emit electrons.) A third, control potential is maintained at the gate 110. The potential at the gate 110 controls the number of electrons emitted from the top of the cathode 140, and, thus, controls the current flowing from the cathode 140 to the anode 112. The potential at the control gate 110 is varied to produce a desired current flow from cathode 140 to the anode 112.

Figure 2B:
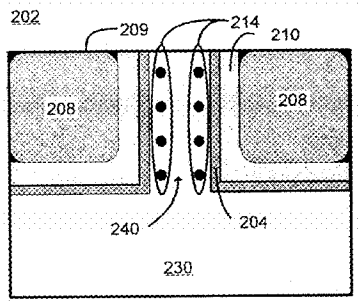
FIG. 2B is a more detailed cross-sectional illustration of the cathode fabrication in the device along cross-section B-B of FIG. 2A, in accordance with principles of the present invention.
Figure 2A:
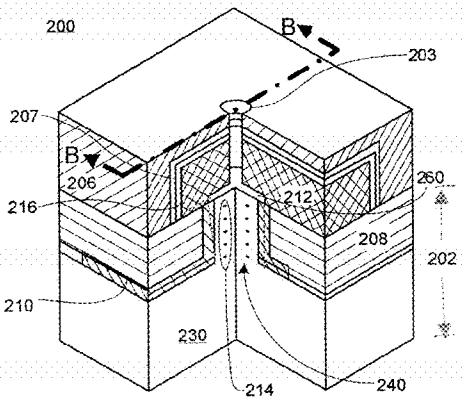
FIG. 2A is a cut view illustration of an embodiment of a device in accordance with principles of the present invention, illustrating the arrangements of the inner layers.

FIG. 2A is a cut view of an embodiment illustrating a detailed structural view of a vacuum gap power handling device 200 in accordance with principles of the present invention. The device 200 consists of a gate-all-around cathode structure 202, a nano-scale vacuum gap 260 and a top anode 212. The device 200 is fabricated on a substrate 230. The cathode 240 is formed on the substrate 230 as a pillar of a desired cross-section surrounded by a control electrode or gate 210. The control electrode or gate 210 conforms to the shape of the cathode, which may be cylindrical, elliptical, oval or rectangular or any polygonal shape. The top anode 212 is fabricated over the cathode 240, and separated from the cathode 240 by the nano-scale vacuum gap 260. An aperture 203 allows gas in the nano-scale vacuum gap 260 to be evacuated to achieve a vacuum. 216 is Anode Contact, 207 is an insulator that isolates the anode from the filler material 206, 208 is a filler material that is capable of passivating the device and 214 is a cathode contact made of a suitable material.

In operation, a vacuum is formed in the vacuum gap 260 as described in the fabrication of the device above, and electric potentials are applied to the cathode 240 and top anode 212 to form an electric field in the vacuum gap 260 sufficient to induce electrons to leave the surface of the cathode 240 and move to the top anode 212. These electrons form a current flow between the cathode 240 and the top anode 212. Because the vacuum gap between the cathode 240 and the top anode 212 is of nano-scale, the required electric field may be provided using relatively low potential difference between cathode 240 and top anode 212 and a low bias at the gate 210.

A potential applied to the control electrode, i.e. all-around-gate 210, forms an electric field within the cathode 240 pillar and at the cathode/vacuum boundary. This electric field controls a conduction path within the cathode pillar 240. The electron density within this conduction path and the electric field across cathode/vacuum boundary will control the current which flows between the cathode 240 and the top anode 212.

FIG. 2B is a more detailed cross-sectional view of the cathode all-around-gate structure 202 along section B-B of the device 200 of FIG. 2A, in accordance with principles of the present invention. In FIG. 2B, the cathode pillar 240 is formed on the substrate 230. It is surrounded by a dielectric layer 204, and a metal gate layer 210. A filler layer 208, which may be any dielectric capable of passivating the device, surrounds the metal layer, and the top surface 209 is planarized.

Figure 3:
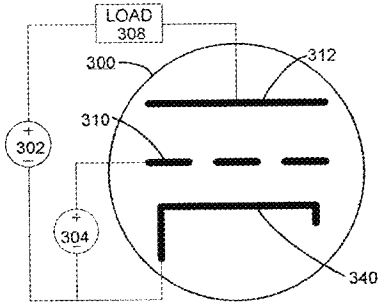
FIG. 3 is a schematic diagram of a nano-vacuum gap power handling device in operation according to principles of the present invention.
Figure 7:
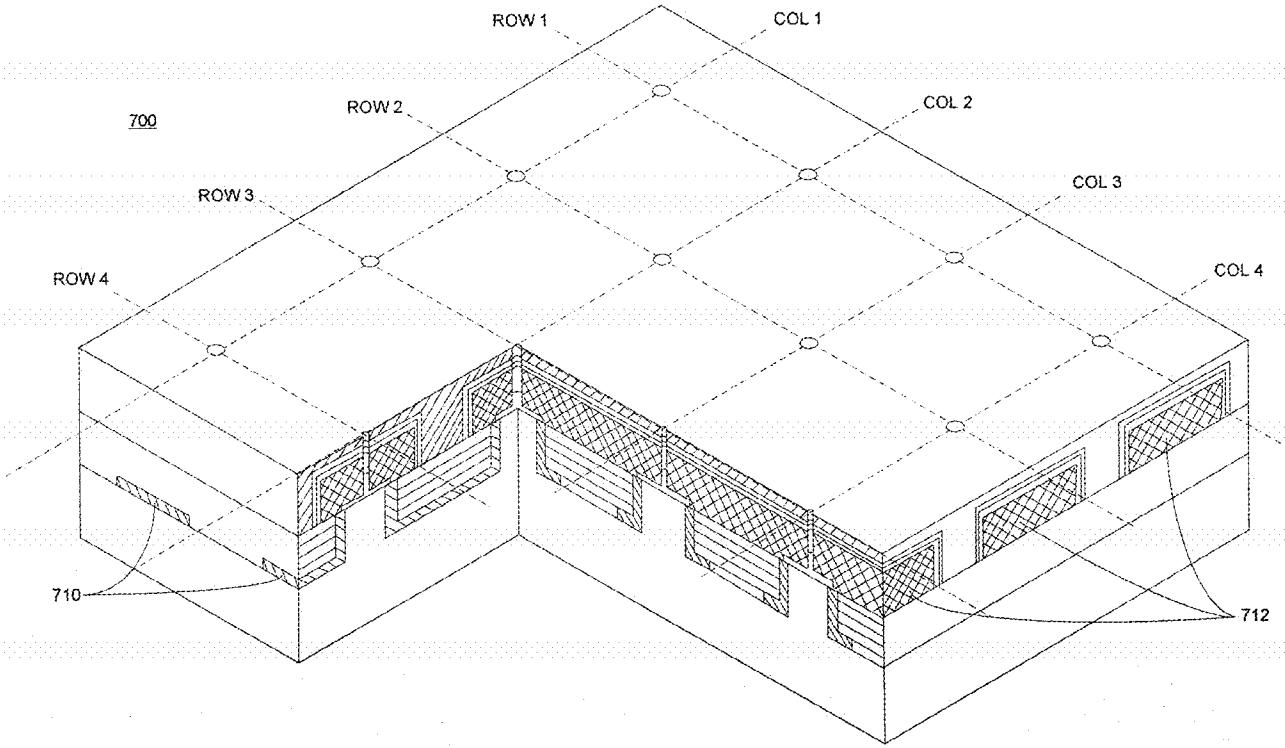
FIG. 7 is an isometric diagram illustrating an array of vacuum gap power handling devices according to principles of the present invention.

FIG. 3 is a schematic diagram of a nano-vacuum gap power handling device 300. The power handling device 300 represents either a single power handling device 100 as illustrated in FIG. 1, or a combination of a plurality of interconnected power handling devices 700 as illustrated in FIG. 7. In FIG. 3, the cathode 340 of the device 300 is coupled to a negative terminal of a power voltage supply 302. The positive terminal of the power voltage supply 302 is coupled to the anode 312 of the power handling device 300 through a load 308. Typically, the power voltage supply is a constant (DC) voltage supply. The cathode 340 of the device 300 is also coupled to the negative terminal of a control voltage supply 304. The positive terminal of the control voltage supply is coupled to the control gate 310 of the power handing device 300. Typically, the control voltage supply will supply a variable voltage representing a desired current through the power handling device 300 and load 308.

In operation, the current produced by the power handling device 300 varies with the control voltage from the control voltage supply. In general, the operational characteristics of the power handling device 300 are dependent on fabrication details, such as materials used, the width of the cold cathode-anode nano-vacuum gap, the cross-section area of the cold cathode, and so forth. A cathode-gate voltage of around 10 volts, and typically less than 10 volts, is expected to enable electron emission from the cold cathode 340 to the anode 312. The anode current is exponentially dependent on the cathode-gate voltage. The breakdown field of the device is expected to be around 1 kV/μm.

Figure 4:
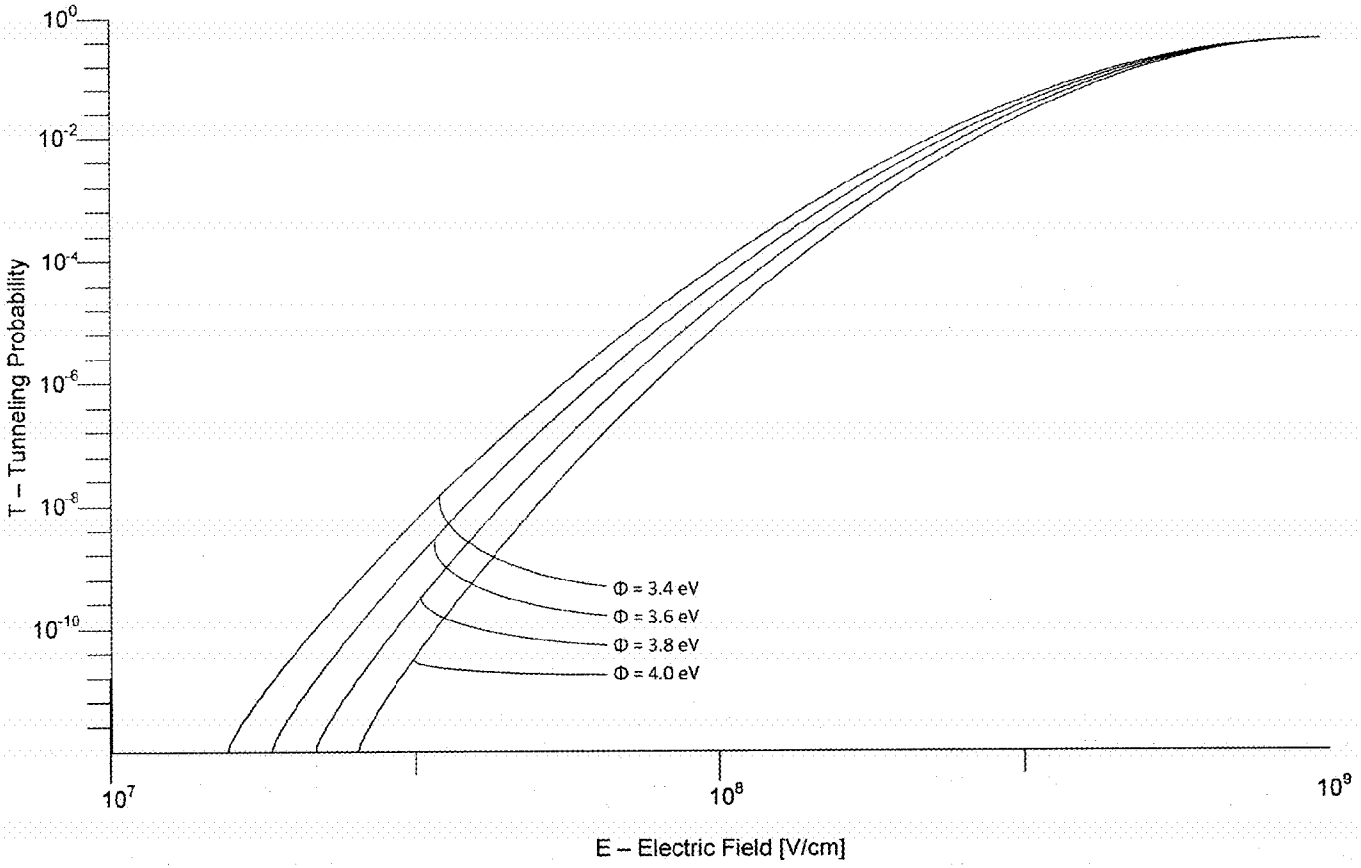
FIG. 4 is a graph illustrating the probability of tunneling for electrons in the cathode for various electric fields and work function values within the cathode of a vacuum gap device according to principles of the present invention.

FIG. 4 is a graph showing the probability of electrons tunneling through the two-dimensional electron gas (2 DEG)/vacuum barrier, i.e. from the surface of the cathode 240 into the surrounding vacuum, for various electric fields and work functions ϕ within the cathode of a vacuum gap vacuum device according to principles of the present invention. The graphs shown are results of simulations and represent approximate device behavior for various work functions In FIG. 4, the tunneling probability T is calculated from the equation:

$$T = \exp\left(-\frac{4}{3}\frac{(2m_{ox})^{1/2}}{q\hbar}\frac{\Phi^{3/2}}{E}\right) \quad (1)$$

where $m_{ox}$ is the effective electron mass, q is an electron charge, $\hbar$ is Planck's constant divided by 2π, ϕ is the work function (described below), and E is the electric field. As illustrated in FIG. 4, the tunneling probability T is very low at electric fields E below $10^7$ V/cm. Just above an electric field E of $10^7$ V/cm, the tunneling probability T rises above $10^{-10}$. As the electric field E approaches $10^9$ V/cm, the tunneling probability T approaches 1 (i.e. $10^0$), meaning that nearly all electrons tunnel through into the vacuum. In addition, a smaller work function ϕ, raises the tunneling probability T for the same electric field E. That is, barrier reduction leads to high electron tunneling probability T.

Figure 5:
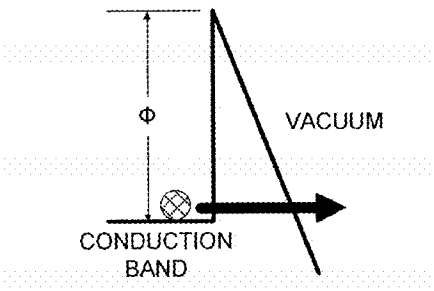
FIG. 5 is an energy diagram illustrating the work function variable $\phi$ used in the equation describing the graph in FIG. 4.

FIG. 5 is an energy diagram illustrating the work function variable ϕ used in the equation (1), above, describing the graphs in FIG. 4. The energy difference between the Fermi level and the emission level into a vacuum is termed the work function and is designated by the symbol ϕ.

FIG. 6A to FIG. 6I are fabrication diagrams illustrating the steps in wafer level fabrication of a gate-all-around nano-vacuum gap power handling device according to principles of the present invention. To increase the local electric field at the 2 DEG/vacuum interface, a pillar structure is fabricated using a self-limited oxidation technique as shown in FIGS. 6A-6I.

Figure 6A:
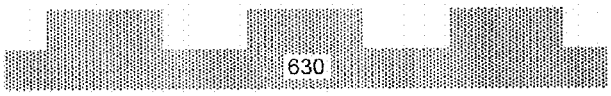
FIG. 6A to FIG. 6I illustrate steps in the fabrication of a nano-gate vacuum power device according to principles of the present invention.
Figure 6B:
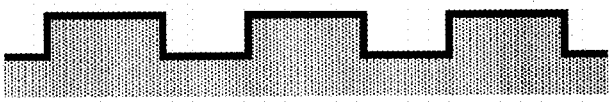
Figure 6C:
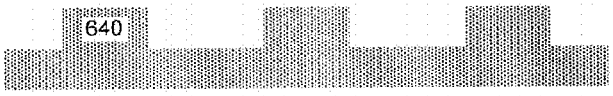

In FIG. 6A, rough silicon pillar shapes are fabricated on a substrate 630 using a lithography/etch process. The height of the pillars may vary depending on the particular design, however they will typically be around the μm range A silicon oxidation layer is formed on the surface of the rough pillar shapes as illustrated in FIG. 6B. The pillar size is refined using a silicon oxidation and etch process, as illustrated in FIG. 6C. This self-limiting process shapes the lithographically defined silicon pillar (FIG. 6A) into a nano-pillar cylinder 640. The nano-pillar cylinder 640 is fabricated to have a cross-sectional size less than 1 micron. In the present application, the cylinder 640 is illustrated (FIG. 2A) as having a circular cross-section (See FIG. 1A) with a diameter of less than 1 micron. However, the nano-pillar 640 may be fabricated to have any cross-sectional shape. For example, the nano-pillar 640 may be fabricated to have a polygonal cross-section, and more specifically a square cross-section, (not shown) having a width of less than 1 micron. Further, the nano-pillar 640 may not be a cylinder at all, with a varying cross-section along its length.

Figure 6D:
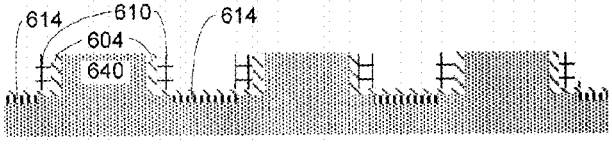

Once the silicon nano-pillar cylinder 640 is formed, a gate-all-around structure is formed by atomic layer deposition (ALD), as illustrated in FIG. 6D. A dielectric layer 604 is fabricated by ALD deposition or oxidation of the surface of the silicon substrate 630. The dielectric layer 604 is fabricated around the side of the nano-pillar cylinder 640 with a thickness of less than 100 nm. A metal layer 610 is fabricated atop the dielectric layer 604 and surrounding the nano-pillar 640 using an ALD process or oblique angle evaporation process. The thickness of the gate metal layer 610 is between 1 nm and 5 microns. A cathode contact 614 is formed by ion implantation, or other technique depending upon the semiconductor used for the fabrication. The cathode contact may be fabricated from any appropriate material and be fabricated of any desired thickness, provided that the cathode contact provides enough current.

Figure 6E:
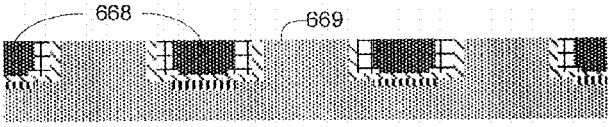

In FIG. 6E, a filler material 668 is deposited by, for example, spin coating or deposition, in the depression formed by the dielectric layer 604 and metal layer 610. The filler is preferably a dielectric which is capable of passivating the surface. A chemical-mechanical planarization (CMP) process is used to planarize the top surface 669 to complete the fabrication of the gate-all-around cathode 640 process.

Figure 6F:
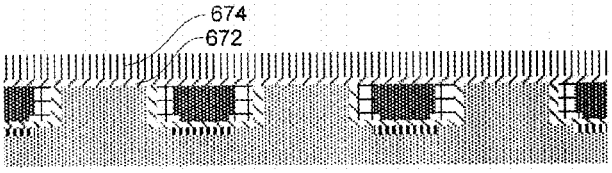

In FIG. 6F, a sacrificial layer 672, which may be a thin dielectric layer, is deposited atop the planarized substrate to subsequently form the nano vacuum gap. The thickness of the sacrificial layer 672 determines the width of the nano-vacuum gap, which is different for different device designs. However, as described above, the nano-vacuum gap is typically less than 100 nm. The material used for the sacrificial layer 672 must have a different etch characteristic when compared to that of the dielectric layer 604 so that when the sacrificial layer 672 is etched later, the etchant will not etch the dielectric layer 604, A covering layer 674, which may be polysilicon, is deposited on the top of the sacrificial dielectric layer 672 in which the anode is formed.

Figure 6G:
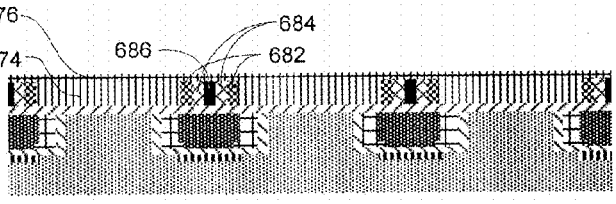

A gate-all-around structure similar to that of the cathode 640 is then fabricated. In FIG. 6G, a silicon oxide, or other dielectric material, dielectric layer 682 is formed by oxidation or ALD deposition around what will be the anode for the gate control anode. A metal anode gate 684 is fabricated around the dielectric layer 682 by ALD or other deposition techniques. This metal anode gate 684 and the gated polysilicon 674 through the dielectric layer 682 provides a gated anode structure. This structure generates a conductive path within the polysilicon layer 674, and allows the control of electron flow through the anode. However, if the polysilicon layer 674 is doped heavily enough, i.e. $>1\times10^{19}/cm^3$, the gate structure is not necessary. In a preferred embodiment, the polysilicon layer 674 is n-doped with phosphorus. After gate formation, a filling layer 686 is fabricated by ALD or other deposition techniques to planarize the device. It will also form an isolation layer where a metal contact to the anode, or the anode gate, will be formed by evaporation.

Figure 6H:
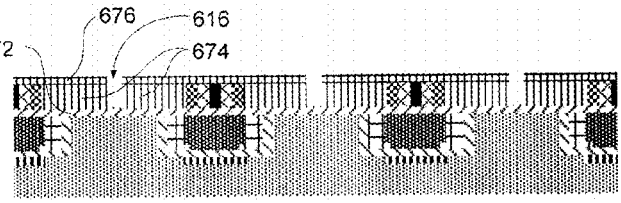

In FIG. 6H, to remove the sacrificial dielectric layer 672, a hole 616 is etched by dry etch such as inductively coupled plasma reactive ion etching through the isolation layer 686 and the covering layer 674 to the sacrificial layer 672. An etch process, which may be a wet etch process, is used to selectively etch the sacrificial dielectric layer 672. To ensure that the sacrificial dielectric layer 672 is not removed completely, a slow etch process is preferred. In addition, or instead, an etch stop layer may be inserted into the dielectric sacrificial layer 672 laterally to enable better control of the channel etch process. For example, a $NH_4OH$ etchant may be used to selectively remove $Al_2O_3$ over $SiO_2$.

Figure 6I:
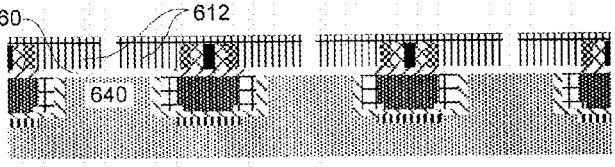

In FIG. 6I, removing a portion of the sacrificial dielectric layer 672 forms the anode 612, and the nano-vacuum-gap 660 between the cathode 640 and the anode 612. In operation, the hole 616 is used to evacuate gas from the nano-gap 660 to form the vacuum condition for the device. One skilled in the art understands that other arrangements of a power handling device are within principles of the present invention, and that other fabrication steps and processes may be used to produce such a power handling device.

One skilled in the art recognizes that the fabrication process illustrated in FIG. 6A to 6I is directed to producing a two dimensional array of nano-vacuum gap power handling devices in accordance with principles of the present invention. FIG. 7 is an isometric view illustrating an array 700 of nano-vacuum gap power handling devices. In array 700, rows ROW 1 to ROW N (not shown) and columns COL 1 to COL M (not shown) of adjacent power handing devices, are illustrated by dashed lines in FIG. 7. The areal density of power handling devices in the array (i.e. the number of power handing devices within a unit area) is greater than $10^5/mm^2$. The linear density of power handling devices in the array (i.e. the number of power handling devices within a unit length) is greater than 100/mm. The anodes 712 of each device in a row are interconnected, and the gates 710 of each device in a column are interconnected. Using the array 700 of interconnected individual nano-vacuum gap power handling devices essentially allows higher power output by combining the respective power outputs from the individual power handling devices in the array 700.

Referring again to FIG. 1, the gate-all-around structure 102 induces a large electric field to form an electron channel inside of the cathode nano-pillar 140. More importantly, it generates a strong field at the end of this electron channel, greatly reducing 2 DEG/vacuum barrier as shown in FIG. 4 and FIG. 5. The barrier thickness reduction leads to high electron emission efficiency.

The use of a nano-scale vacuum gap reduces the bias voltage needed to induce current flow between the cathode and the anode. The nano-scale vacuum gap, in combination with ballistic transport of electrons in a vacuum, enables high frequency and low noise operation. The low voltage, high emission efficiency cathode provides high current density. Together with the higher breakdown voltage of a vacuum device, a power handling device according to principles of the present invention provides high power handling capability for a nano-scale vacuum gap device array.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

The invention claimed is:

1. A semiconductor power handling device, comprising:
a cathode pillar;
a gate surrounding the cathode pillar; and
an anode spaced from the cathode pillar by a nano-vacuum gap.

2. The device of claim 1 wherein the cathode pillar is a prism of any cross section.

3. The device of claim 1 wherein the cathode pillar has a width of between 100 nm to 1 μm.

4. The device of claim 1 wherein the cathode pillar has a height of between 10 nm and 10 μm.

5. The device of claim 1 wherein the cathode pillar is a pyramid.

6. The device of claim 5 wherein the cross-section of the pyramid is a circle.

7. The device of claim 5 wherein the cross-section of the pyramid is any polygon.

8. The device of claim 1 wherein the cathode pillar has a varying cross-section from pillar bottom to pillar top.

9. The device of claim 1 wherein said nano-vacuum gap has a width of between 1 nm and 1 μm.

10. The device of claim 1 wherein the gate comprises: a dielectric layer on the side of and surrounding the cathode pillar; and a gate layer on the side of and surrounding the dielectric layer.

11. The device of claim 1 wherein the vacuum level within the nano-vacuum gap is between 1 microtorr and 10 Torr.

12. The device of claim 1 wherein the device is fabricated monolithically on a semiconductor substrate.

13. The device of claim 12 wherein the semiconductor substrate is selected from a group consisting of Si, GaN, diamond, and SiC.

14. The device of claim 1 wherein the anode material is selected from a group consisting of Si, GaN, diamond, and SiC.

15. The device of claim 1 replicated in an array on a substrate with each device comprising a cathode pillar, a gate surrounding the cathode pillar, and an anode spaced from the cathode by a nano-vacuum gap wherein the devices are interconnected.

16. An array of semiconductor power handling devices, each comprising a cathode pillar, a gate surrounding the cathode pillar, and an anode spaced from the cathode pillar by a nano-vacuum gap.

17. The array of devices of claim 16, wherein the array comprises the power handling devices arranged in an array of adjacent rows and columns.

18. The array of claim 17 wherein anodes of adjacent power handling devices in a row are interconnected.

19. The array of claim 17 wherein gates of adjacent power handling devices in a column are interconnected.

20. The array of claim 17 wherein the areal density of power handling devices in the array is greater than $10^5$ device/$mm^2$.

21. The array of claim 17 wherein the linear density of power handling devices in the array is greater than 100 device/mm.

22. A method for fabricating a power handling device on a semiconductor substrate, comprising:

fabricating a cathode pillar;

fabricating a gate surrounding the cathode pillar; and fabricating an anode spaced from the cathode pillar by a nano-vacuum gap.

23. The method of claim 22 wherein fabricating the cathode pillar comprises:

fabricating a pillar on the semiconductor substrate using a lithography/etch process;

forming a substrate oxidation layer atop the substrate and pillar; and refining the pillar using a substrate oxidation/etch process to form the pillar having a size less than one micron.

24. The method of claim 22 comprising refining the cathode pillar to have a circular cross-section.

25. The method of claim 22 comprising refining the cathode pillar to have a polygon cross-section.

26. The method of claim 22 wherein fabricating a gate surrounding the cathode pillar comprises:

forming a dielectric layer surrounding the cathode pillar having a thickness of less than 100 nm; and depositing a metal gate layer over the dielectric layer and surrounding the cathode pillar using atomic layer deposition, and having a thickness between 1 nm to 5 microns.

27. The method of claim 26 further comprising after fabricating the gate surrounding the cathode pillar, implanting a cathode contact beneath the dielectric layer in the substrate using an ion implantation process.

28. The method of claim 26 further comprising after fabricating the gate surrounding the cathode pillar:

filling depressions in the substrate with a filler material; and planarizing the substrate using a chemical-mechanical planarization process.

29. The method of claim 26 wherein fabricating an anode separated from the pillar by a nano-vacuum gap comprises:

depositing a sacrificial layer on the surface of the substrate; depositing a covering layer on the surface of the sacrificial layer; drilling a hole through the covering layer to the sacrificial layer;

removing a portion of the sacrificial layer using an etch process to form a nano-vacuum gap between the cathode and anode.

30. A method for using a semiconductor power handing device having a cathode comprising a cathode pillar and a cathode contact, a gate surrounding the cathode pillar and an anode spaced from the cathode pillar by a nano-vacuum gap and connected to an anode contact, comprising:

coupling a power voltage supply and a load between the cathode contact and the anode contact;

coupling a control voltage supply between the cathode contact and the gate; and varying the voltage of the control voltage supply to vary the current through the load.

31. The device of claim 1 wherein said nano-vacuum gap has a width that is less than the electron mean free path in the environment surrounding said nano-vacuum gap; and wherein the vacuum pressure in said nano-vacuum gap is comprised between 1 microtorr and atmospheric pressure.

* * * * *